United States Patent [19]

Verby et al.

[11] Patent Number: 4,930,275

[45] Date of Patent: Jun. 5, 1990

[54] SKYLIGHT ASSEMBLY

[76] Inventors: Stanley M. Verby, 218 Albon Rd., Hewett Harbor, N.Y. 11557; Barry Mirsky, 159 Wedgewood Dr., Haupaugue, N.Y. 11788

[21] Appl. No.: 194,817

[22] Filed: May 17, 1988

[51] Int. Cl.[5] ..... E04B 7/18

[52] U.S. Cl. ..... 52/200; 49/DIG. 1

[58] Field of Search ..... 52/200, 82, 309.1, 475, 52/72; 49/DIG. 1

[56] References Cited

U.S. PATENT DOCUMENTS

| | | | |
|---|---|---|---|
| 2,790,400 | 4/1957 | Wasserman | 52/200 |
| 3,111,786 | 11/1963 | Wasserman | 52/200 |
| 4,409,767 | 10/1983 | Jentoft et al. | 52/200 |
| 4,449,340 | 5/1984 | Jentoft et al. | 52/200 |
| 4,455,799 | 6/1984 | Jentoft et al. | 52/309.1 |
| 4,466,221 | 8/1984 | Couture | 52/200 |
| 4,527,368 | 7/1985 | Jentoft | 52/200 |
| 4,570,394 | 2/1986 | Jentoft et al. | 52/200 |
| 4,589,238 | 5/1986 | Sampson et al. | 52/200 |
| 4,776,141 | 10/1988 | Powell | 52/200 |

FOREIGN PATENT DOCUMENTS

| | | | |
|---|---|---|---|
| 641781 | 5/1962 | Canada | 52/200 |
| 673047 | 10/1963 | Canada | 52/200 |
| 1070471 | 1/1980 | Canada | 52/200 |
| 1201264 | 3/1986 | Canada | 52/200 |
| 2923765 | 12/1979 | Fed. Rep. of Germany | 52/200 |

*Primary Examiner*—John E. Murtagh
*Assistant Examiner*—Caroline D. Dennison

[57] ABSTRACT

A skylight includes a frame curb assembly which is integrally molded to provide an upright external wall portion and a depending interior wall portion, the latter extending within the associated building structure and having a mounting flange which is adapted for fastening the entire assembly to the building structure from the inside of the building. The upright external wall has an integrally formed flashing flange extending outwardly to rest on an outside surface (roof) of the building. A bulbous bead is provided at the outermost extremity of each side of the flange to impart rigidity along each side. The bead is terminated in the vicinity of each corner of the flange to provide a fluid run-off.

15 Claims, 1 Drawing Sheet

SKYLIGHT ASSEMBLY

This invention relates to a skylight or roof window assembly or the like and, in particular, to frame curb configurations for such assemblies and to methods of installing or using such assemblies in a roof or similar building structure.

BACKGROUND OF THE INVENTION

The recent interest in contemporary architecture, particularly in connection with residential building, has resulted in a very substantial increase in the demand for skylight assemblies, either fixed glazing type or of the operating (openable) type. In either case, ease of manufacture (with resultant lowered cost) and ease of installation are important objectives in designing the skylight assemblies. Since these skylight assemblies are installed in structures having a wide range of pitches (from almost flat roofs to mansard walls which are almost vertical), two additional important criteria must be met in the design of such assemblies. First, extreme care must be taken to insure that the assembly provides a leak-free interface with the structure in which it is to be mounted. Secondly, and this requirement is also related in part to the first, it is preferable that the assembly be fastened to the structure from the interior of the structure in a manner which is both aesthetically acceptable and, at the same time, does not affect the watertight integrity of the overall condition of roof and skylight.

Typically, in prior skylight assemblies, separate flashing materials (e.g. copper or aluminum or plastic sheets) are attached at the junction of the skylight assembly and the roof in the same manner as is employed, for example, with chimneys or other vertical structures. That type of configuration usually entails inserting nails, screws or other penetrating fasteners through the flashing material into the roof sheathing and thereafter sealing the resulting holes with roof cement. Other arrangements have been proposed utilizing an extruded plastic flashing flange integral with or fastened to one or another type of curb assembly (see, for example, U.S. Pat. Nos. 4,449,340; 4,455,799; 4,527,368; 4,570,394; 4,466,221 and 4,589,238 for typical alternative arrangements). Furthermore, in such prior arrangements, the skylight assembly itself is often fastened to the roof structure by nailing or inserting other penetrating fasteners from the outside through both the skylight materials and the roof. Thereafter, cement is applied to attempt to achieve a watertight assembly. Such configurations are subject to leaking and may have a relatively limited leak free lifetime.

These and other problems related to prior practices are intended to be overcome by the present invention.

SUMMARY OF THE INVENTION

In accordance with one aspect of the present invention, a skylight assembly for an opening in a building comprises glazing means having a geometric shape and size suited for covering the building opening while allowing light to enter and a frame surrounding the periphery of the glazing means in watertight relationship. The frame has a depending skirt which extends over a frame curb assembly attached to the frame. The frame curb assembly is shaped in conformity with and is adjusted for insertion in the opening and attachment to the building. The frame curb assembly comprises an upright wall portion extending upwardly adjacent to the inside of the skirt portion towards the glazing means and having inner and outer upright surfaces. A flashing flange is integrally formed with the outer upright surface, extends outwardly from the outer surface and is adapted to rest on an outside surface of the building adjacent the opening. A mounting flange is integrally formed with the upright wall portion and has an outer wall recessed with respect to the outer upright surface and an inner wall substantially aligned with the inner upright surface. The inner wall extends in a direction opposite to the upright wall portion sufficiently to lie inside the building. Webs are provided within the mounting flange and are adapted for accepting fasteners inserted through the inner wall to fasten the assembly to the building from an interior position.

DETAILED DESCRIPTION OF PREFERRED EMBODIMENTS

Figure 1:
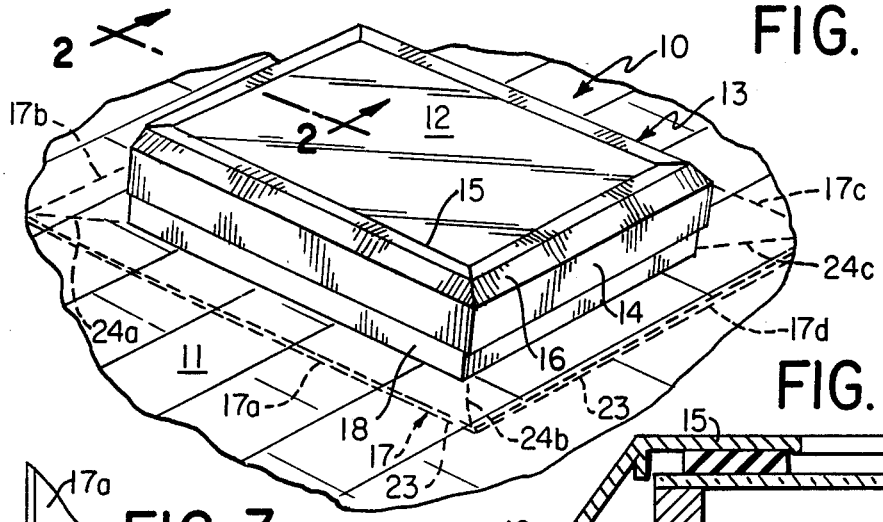
FIG. 1 is a top perspective view of one type of skylight or roof window assembly constructed in accordance with the present invention, which assembly is shown in the process of being installed through the roof of a structure.

Referring to FIG. 1, a skylight assembly indicated generally by the reference numeral 10 is shown in its normal, installed orientation with respect to a roof 11 of a structure (not shown).

Assembly 10 comprises a transparent or translucent glazing member 12 formed of one sheet, or, in the case of a thermal insulating arrangement, of a plurality of sheets of glass or plastic material fastened in a watertight fashion within a window frame assembly 13. Window frame assembly 13 is generally conventional in construction. Frame assembly 13 includes a downwardly extending skirt 14, an upper channel member 15 for receiving and supporting the glazing material 12 and a sloped transition portion 16 between channel 15 and skirt 14. The frame assembly 13 typically is formed from extruded metal stock such as aluminum which is appropriately cut (mitered) and welded to form the desired box structure as is shown in FIG. 1. The illustrated window frame assembly 13 is of the type generally employed for an operating window (i.e. one which may be opened and closed from inside). The operating mechanism (not shown) may be of a conventional type and typically is fastened along two opposite sides of the frame.

The window frame assembly 13 is supported with respect to roof 37 by means of a frame curb assembly 17. Frame curb assembly 17 may be made of any suitable material but preferably is formed by extrusion of polyvinylchloride (PVC) plastic material.

Figure 2:
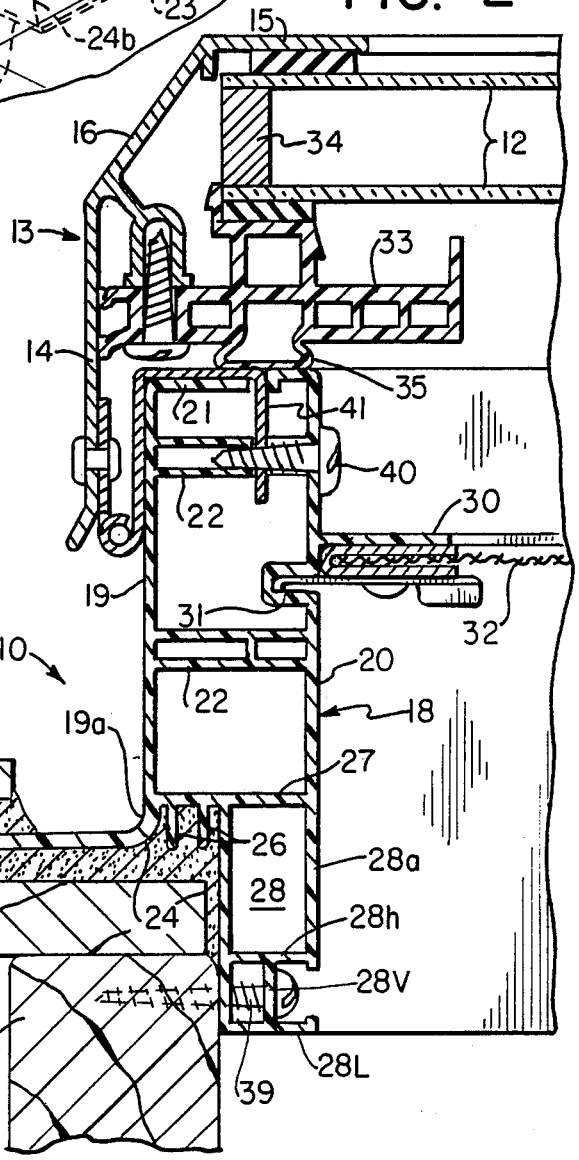
FIG. 2 is a partial sectional view taken along the line 2—2 of FIG. 1.

A cross-section of the extrusion for curb assembly 17 is shown in FIG. 2. The required closed structure for curb assembly 17 (shown as including four sides 17*a*, 17*b*, 17*c* and 17*d*) is formed by cutting (mitering) two pieces to the required length and two pieces to the required width suitable for fitting under and within a predetermined window frame assembly 13 in a watertight configuration. The four pieces 17*a*–17*d* are joined together along their (45°) mitered edges 24*a*, 24*b*, 24*c* and 24*d* (the latter being hidden) by thermally welding the edges together.

As can be seen generally in FIG. 1, and, in a more detailed fashion in FIG. 2, the frame curb assembly 17 comprises an exterior upright portion 18 having substantially smooth and straight outer and inner walls 19 and 20 joined by an upper ledge 21. Double-walled stiffening webs 22 (see FIG. 2) which include horizontal and vertical members, are provided between walls 19 and 20. Two such webs 22 are shown and are disposed at appropriate points to accept fasteners 40 (screws) associated with the closing mechanism (not shown) and hinges 41. Typically, walls 19 and 20 are spaced apart by 1.125 inches. This dimension is provided only to give some indication of scale but is not a required size.

An integral flashing flange 23 extends outwardly from a lower end 19*a* of outer wall 19 at a shallow, downward acute angle (e.g. about 1½°). A rounded strengthening fillet 24 preferably is provided at the junction of flashing flange 23 and outer wall 19. The far end of flashing flange 24 remote from outer wall 19 is terminated in a bulbous bead or knob shape 25 as will be explained more fully below.

One or more engaging ridges 26 are provided inwardly of outer wall 19 along a lower face of a lower ledge 27 which is fastened between outer wall 19 and inner wall 20 at or near the bottom end 19*a* of outer wall 19. In addition, a double-walled inner mounting flange 28 is attached to and extends downwardly from ledge 27. Preferably the inner wall 28*a* of mounting flange 28 is collinear with inner wall 20 and is integrally formed with wall 20 to provided a smooth and unbroken inner lining within the roof opening. The thickness of mounting flange 28 is less than the width of upper ledge 21 so that frame curb assembly 17 may be installed (as will be explained below) in a rough roof opening framed by rafters 29 and perpendicular headers (not shown). The lower end 28L of mounting flange 28 preferably is reinforced by means of internal horizontal and vertical webs 28*h*, 28*v* to provide adequate strength for fastening the assembly to the rafters 29 and headers in a particularly advantageous manner from within the building structure.

The inside portion of inner wall 20 preferably includes a support flange 30 for sealing and supporting a removable insect screen 32, and a groove 31 disposed in the inner wall 20 for receiving a conventional pivotal tab which secures the insect screen up against the support flange 30.

As is shown in FIG. 2, the window frame assembly 13 itself may include a condensation gutter 33 and mounting means 34 for supporting the appropriate glazing material 12 (shown as a double pane of glass with an integral aluminum sealing spacer 34). A gasket 35 of soft or hollow vinyl plastic (flexible-vinyl) is provided to effect a tight seal between window frame assembly 13 and upper ledge 21 when the overall arrangement is in a closed position. Hinges 41 and a locking and elevating mechanism (not shown) are provided, respectively, along the upper and lower sides 17*b* and 17*d* of curb assembly 17 in the case where the window frame assembly 13 is to be opened and shut. Alternatively, fasteners such as screws (not shown) may be inserted between skirt 14 and curb assembly 17 in the case where a non-operating (always closed) arrangement is desired. The foregoing opening, closing and fastening arrangements may be conventional in nature and are well known. However, as noted above, the strengthening webs 22 are advantageously located to mount such arrangements.

The installation into a roof (or wall or the like) of a combined window frame 13 and curb assembly 17 is accomplished in the following manner.

As is customary, the desired placement of a skylight with respect to an interior ceiling, taking into account the location of roof rafters, is selected. Preferably, the skylight is positioned so as to sever the fewest roof rafters and/or ceiling joists as possible. In the case where the ceiling material is fastened directly to roof rafters, markings are made on the interior ceiling corresponding to the desired opening. The ceiling material then is cut through and removed. Nails are driven through the roof at the four corners of the ceiling opening to provide a guide for removal of roofing materials, roof sheathing and, if necessary, portions of joists. Those nails will be visible from on top of the roof.

In the case where an attic space exists between the ceiling and roof, the appropriate lines are carried between ceiling and roof making use of a spirit level and/or plumb bob, or the like to locate the four nails in the roof relative to the corners of the ceiling opening.

Using the four protruding nails as a guide, the roof opening may then be cut.

When the roofing, sheathing, rafters and ceiling joists, as required, have been removed, the rough frame opening is completed by installing headers where rafters and/or joists have been removed. The opening may be "packed out" between rafters, if required. The roofing material such as shingles should be removed for a distance of at least ten inches from the edge of the opening.

Next, a generous application of roof cement 36 (see FIG. 2) is provided around the complete framed opening on top of the roof sheathing 37. The entire skylight assembly 10 is placed over the opening, taking care that all four corners are properly aligned with the interior opening. The flashing flange 23 is then pressed down into the roof cement 36 so as to cover substantially the entire flange 23, including the bulbous bead 25 (see FIG. 2). The ridges 26 will be filled with cement 36 as well (see FIG. 2). In the case where any clearance exists between the rough frame opening members 29 and the double-walled lower mounting flange 28, it may be expected and it is desirable that roofing cement 36 will extend into that clearance. Of course, appropriate shimming and/or packing materials should be provided at least in the vicinity of fasteners (as will be described below).

The entire skylight assembly is then fastened to the roof rafters and framing from the inside of the structure by inserting screws 39, as shown, or other suitable fasteners which pass through the reinforced lower end 28L of double-walled mounting flange 28 into the rafters 29 (or headers at the top and bottom 17*b* and 17*d*). A relatively large hole is provided in the inner wall 28*a* so that the entire fastener 39, including its head, can pass through. The vertical wall 28*v* is only drilled to provide a smaller pilot hold sufficient to accept the screw thread. The fasteners 39 are inserted on all four sides 17*a*–17*d* and appropriate shims may be inserted between the structure and sides 17. The relatively large hole accepting the fastener screws 39 can later receive caps which snap into the large hole and conceal the fastener screw head. These caps (not shown) can be made from many materials including PVC, rubber, wood and metal and can be used according to the interior finish desired.

The finish roofing materials (shingles) are thereafter reapplied to the exposed sheathing adjacent the bulbous bead 25 and appropriate roof cement 36 is applied to complete the sealing of the roof in the vicinity of the flange 23, as shown in FIG. 2. Shingles are returned over the flashing flange 23 but do not make contact with the outer vertical wall 19. A space along the flashing flange 23, parallel to each side is provided between the edge of the shingles 11 and the vertical wall 19. This space, together with the applied roof cement 36 and the outer vertical wall 19 forms a channel or gutter which encourages nearby rain water to run-off past the vulnerable area near the flashing flange 23. Otherwise, water would collect under the shingles 11 and would rot the shingles and deteriorate the bond between the roof cement 36 and either the flashing flange 23 and/or the shingles 11 resulting in an interior leak in due time.

The frame curb assembly 17 described above provides a particularly good watertight seal with respect to the roof opening. By providing the bulbous bead 25 on flashing flange 23, a better seal is created between the flashing flange 23 and the roof cement 36, thereby providing a difficult path for rain water to follow from the roof to the home interior. In order for a leak to occur inside the home, rain water must penetrate the barrier provided by the roof cement 36 under the shingles 11 and on top of the flashing flange 23, pass around the bulbous bead 25, and continue towards the home interior. The bulbous bead 25 also assists in initially securing the flashing flange 23 to the roofing cement 36 which prevents unintentional movement of the skylight until it is more permanently secured to the roof 37. Furthermore, the bulbous bead 25 imparts rigidity to the outermost edge of the flange along each side 17*a–d*, thereby assisting in maintaining each of the four sides of the flange 23 flat on the roof deck 37.

The bulbous bead 25 along each side of the flashing flange 23 provides rigidity to the overall skylight flashing flange 23 and prevents edge warpage from occurring along each side of the flashing flange 23, unlike the prior art flashing not having a bulbous bead. The four corners of the present frame, however, are sufficiently rigid to avoid edge warpage with or without the bulbous edge bead 25. Therefore, the edge bead is preferably removed at each corner, along with any excess PVC material that has seeped out along the mitered edges 24*a–d* during the thermal welding procedure described above. This beadless area at each corner is preferably less than an inch along each side of the flashing flange 23 and can be removed using a cutting router (not shown) during production.

The excess PVC material normally protrudes outwardly from the flashing surface (top and bottom) along the miter joint following an unpredictable path which is usually wider than the bulbous bead 25. If the excess PVC material is not removed the possibility exists that the mitered corners of the flashing flange, along which the excess protrudes unevenly, will not penetrate and become secured into the roof cement, but will become detached, forming a possible path for rain water to enter the home interior. Also, with the excess protruding from the flashing flange 23, the mitered corners becomes rigid which makes each corner more susceptible to cracking and separation.

The removal of the bulbous bead 25 at each corner 24*a–d* and the excess PVC material along each miter provides the corner with more flexibility thereby, discouraging cracking due to thermal expansion and contraction and accidental corner impact during installation and allowing the flashing flange 23 to more securely set into the roof cement 36.

The overall assembly is preferably held within the roof opening only by means of internal fasteners 29 to ensure a better watertight arrangement and to maintain a more secure retention of the assembly in the opening. The fasteners 39 readily may be concealed from view from below by virtue of their being recessed and by inserting above-mentioned caps in inner wall 28 on (not shown) or by using trim placed below the lower end 28L and/or extending upwardly as, for example, by the use of a corner bead molding of wood or plastic.

Figure 3:
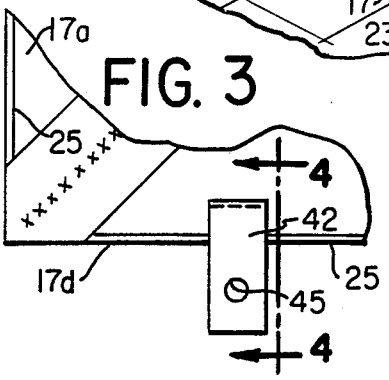
FIG. 3 is an enlarged top partial view of one corner of a flashing flange of the present invention showing details of a bulbous bead clip.
Figure 4:
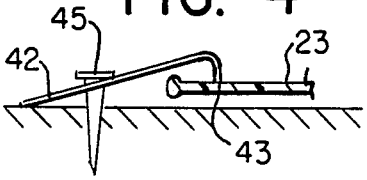
FIG. 4 is an enlarged side partial view of the flashing flange of the present invention showing details of the securing clip in a securing position.
Figure 4:
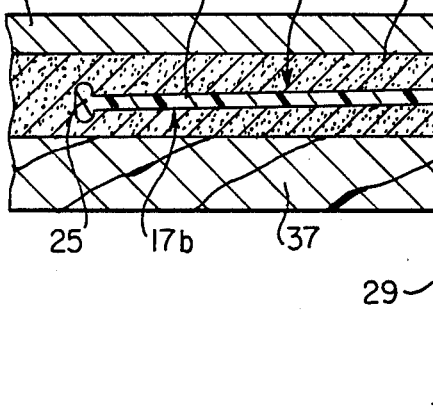

However, common installation practice used by commercial installers dictates the effectiveness of this above-mentioned internal fastening technique of the present invention. It is quite common for an installer (not following the instructions) to, in addition to the internal fasteners or as a quicker alternative, penetrate the flashing flange directly with nails or screws to secure it to the roof. By doing so, the effectiveness of the water tight system of this invention is jeopardized. In order to prevent such damaging installation tendencies and to provide a more water tight alternative to securing from within than penetrating the flashing flange, the present invention offers clips 42 which secure the flashing flange 23 into the roof cement 36 from outside the perimeter of the bulbous bead 25, as shown in FIGS. 3 and 4. Each side of the frame is preferably held down by two clips 42, evenly spaced. The clips 42 are shaped so that a first edge 43 of the clip engages with the top surface of the flashing flange 23 just inwardly past the bulbous bead 25 and a second edge 44 engages with the surface of the roof 37, as shown in FIG. 4 when a nail or screw is driven through a hole 45 in the clip 42, penetrating the roof 37 adjacent to the flashing flange 23. The clips 42 are shaped with a relatively low profile so that the shingles 11 can be replaced over the clips 42 (if clips are used) and the flashing flange 23 without becoming deformed or otherwise damaged. If clips 42 are used, extra roof cement 36 should be applied outside the perimeter of the bulbous bead 25 so that any fasteners penetrating the roof 37 to secure the clips 42 will not easily provide passage of rain water into the home.

By providing the external clips 42 to secure the flashing flange 23 to the roof as a secondary leak preventive measure in addition to the internal fasteners or as its alternative, it is less likely that the installer will by-pass the benefits of the present invention by driving fasteners directly through the flashing flange 23. The installer has the option of solely using the above-mentioned internal fastening technique or using the external clips 42 to secure the flashing flange 23 to the roof or both.

The foregoing and other advantages of the present invention will be readily apparent form the description. It should also be noted that numerous modifications in shape and size may be made without departing from the scope of the present invention which is set forth in the following claims.

What is claimed is:

1. A skylight assembly for an opening through a surface of a roof of a building, said opening having a periphery which is substantially coplanar with said roof surface and does not include a raised curb, said assembly comprising:

glazing means having a geometric shape and size suitable for substantially covering said opening while allowing light to enter;

a frame surrounding the periphery of said glazing means and having a depending skirt portion;

a frame curb assembly shaped in conformity with and adapted for insertion into said opening and attachment to said roof from the interior, said frame curb assembly comprising;

an upright wall portion adjacent an inner wall of said skirt portion, extending towards said glazing means and having inner and outer upright surfaces, said upright wall portion including a cavity between said inner and outer upright surfaces;

a flashing flange integrally formed with said outer upright surface extending outwardly from said outer surface and adapted to rest on said roof surface of said building adjacent said opening;

a mounting flange integrally formed with said upright wall portion, said mounting flange being defined by an inwardly directed recessed portion of said upright wall, said mounting flange including an outer wall and an inner wall with a cavity therebetween, said inner wall being substantially aligned with said inner upright surface and said outer wall lying in a substantially parallel plane between the inner upright surface and the outer upright surface, said mounting flange extending into the interior of said building, said mounting flange being adapted to function as a raised curb assembly along the periphery of said opening; and fastening webs with said cavity of said mounting flange for accepting fasteners inserted from the interior of said building through said inner wall of said mounting flange to fasten said assembly to said building, said fastening webs providing reinforcement to said frame curb.

2. A skylight assembly according to claim 1 wherein said frame curb assembly including said wall portions, said flashing flange, said mounting flange and said fastening webs is integrally extruded to form a continuous, uninterrupted structure along at least each side of said opening in said building.

3. A skylight assembly according to claim 1 wherein said frame curb assembly is formed from a plurality of side portions corresponding to said opening, each side portion including said flashing flange, said mounting flange and said fastening webs being integrally extruded and made of plastic adapted for welding by heat, said side portions being welded together at their junctions to form a watertight frame curb assembly.

4. A skylight assembly according to claim 1 wherein said mounting flange includes a recessed portion for accepting fasteners from within said building, said recessed portion directed outwardly from said inner upright surface and being adapted to conceal a head portion of said fastener from view.

5. A skylight assembly for a plural sided opening through a surface of a roof of a building, said opening having a periphery which is substantially coplanar with said roof surface and does not include a raised curb, said skylight assembly comprising:

glazing means having a geometric shape and size suitable for substantially covering said opening while allowing light to enter;

a frame surrounding the periphery of said glazing means and having a depending skirt portion;

a plural sided frame curb assembly attached to said frame, said frame curb assembly being shaped in conformity with and adapted for insertion into said opening and attachment to said roof surface, said frame curb assembly adapted to function as a raised curb assembly, said frame curb assembly comprising:

a plurality of upright wall portions corresponding in number to the number of sides of said opening, each of said upright wall portions extending adjacent an inner side of said skirt portion towards said glazing means and including inner and outer upright surfaces, said upright wall portions being joined together to form respective continuous inner and outer upright surfaces, said upright wall portions including an insulating cavity between said inner and outer upright surfaces;

flashing flanges integrally formed with each said outer upright surface, extending outwardly from their respective associated outer surfaces, adapted to rest on said roof surface of said building adjacent said opening and having a bead at an end remote from said upright surface, said bead including a portion which extends both above said flashing flange away from said roof surface and below said flashing flange towards said roof surface thereby creating a watertight anchor around which a securing cement may be applied; and means for sealing said flashing flange, said beads and said outer upright surfaces at their junctions to form a substantially watertight frame curb.

6. A skylight assembly according to claim 5 wherein said sides of said curb assembly are formed by extruding a heat weldable plastic.

7. A skylight assembly according to claim 5 wherein said bead along said remote end of each of said flashing flange terminates prior to each of said junctions.

8. A skylight assembly according to claim 5 wherein said sealing means comprises a weld formed by heating said flashing flange, beads and outer surfaces while in contact with each other and thereafter cooling the junction to form a watertight frame curb.

9. A skylight assembly according to claim 5 wherein said flashing flanges extend at a shallow downward acute angle from said outer wall.

10. A frame curb assembly for a skylight, the skylight including glazing means having a geometric shape and size suitable for substantially covering an opening in a building while allowing light to enter and a frame surrounding the periphery of said glazing means and having a depending skirt portion, said frame curb assembly comprising:

a plurality of upright wall portions corresponding in number to the number of sides of said opening and adapted to extend adjacent an inner side of said skirt portion towards said glazing means and each having inner and outer upright surfaces, said outer wall portions being joined together and said inner wall portions being joined together to form respective continuous inner and outer walls;

flashing flanges integrally formed with each said outer upright surface, extending outwardly from their respective associated outer surfaces, adapted to rest on an outside surface of said building adjacent said opening and having a bead at an end remote from said upright surface and each having two edges lying adjacent complementary edges of an adjacent flashing flange, said bead terminating prior to each junction formed by two adjacent flashing flanges; and means for sealing said flashing flanges and said outer upright surfaces at their junctions to form a substantially watertight frame curb.

11. A frame curb assembly for a skylight to be mounted to an outside roof surface of a building around an opening formed within said outside roof surface, the skylight including glazing means having a geometric shape and size suitable for substantially covering said opening while allowing light to enter and a frame surrounding the periphery of the glazing means, the periphery of said opening being substantially coplanar with said roof surface, the frame curb assembly comprising:

an upright wall portion having inner and outer upright surfaces shaped in conformity with said opening;

a flashing flange integrally formed with said outer upright surface extending outwardly from said outer surface and adapted to rest on said outside surface of said building adjacent said opening;

a mounting flange integrally formed with said upright wall portion, having an outer wall recessed with respect to said outer upright surface and an inner wall substantially aligned with said inner upright surface and extending inside the building, said mounting flange being adapted to function as a raised curb assembly along the periphery of said opening; and fastening webs within said mounting flange for accepting fasteners inserted from the interior of said building through said inner wall of said mounting flange to fasten said assembly to said building.

12. A frame curb assembly for a skylight according to claim 11 wherein said inner wall of said mounting flange includes a recessed portion for accepting fasteners inserted from the interior of said building.

13. A frame curb assembly for a skylight according to claim 12 wherein said fastening webs comprise two horizontally disposed webs extending between said inner and outer walls and a recessed vertical web extending between said horizontally disposed webs for retaining a fastener recessed relative to said inner wall.

14. A frame curb assembly according to claim 13 wherein said outer wall of said mounting flange is recessed with respect to said outer upright surface of said wall portion by an amount sufficient to allow said wall portion to overlap the structure of the building.

15. A frame curb assembly according to claim 13 wherein said flashing flange includes a bead extending along an outermost edge thereof for stiffening said flashing flange.

* * * * *